US006542150B1

(12) United States Patent
Kotha et al.

(10) Patent No.: US 6,542,150 B1
(45) Date of Patent: Apr. 1, 2003

(54) METHOD AND APPARATUS FOR ASYNCHRONOUS DISPLAY OF GRAPHIC IMAGES

(75) Inventors: Sridhar Kotha, Fremont, CA (US); Vlad Bril, Campbell, CA (US); Alexander J. Eglit, Half Moon Bay, CA (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 08/671,873

(22) Filed: Jun. 28, 1996

(Under 37 CFR 1.47)

(51) Int. Cl.[7] ..... G09G 5/00
(52) U.S. Cl. ..... 345/213; 345/53; 345/208
(58) Field of Search ..... 345/3, 132, 133, 345/213, 1.1, 3.1, 53, 500, 531, 660, 208; 341/61; 348/500, 537, 497, 715

(56) References Cited

U.S. PATENT DOCUMENTS

| | | | | | |
|---|---|---|---|---|---|
| 5,150,201 | A | * | 9/1992 | Mehrgardt et al. | 348/537 |
| 5,267,045 | A | | 11/1993 | Stroomer | 358/241 |
| 5,268,750 | A | | 12/1993 | Stec et al. | 358/11 |
| 5,274,372 | A | * | 12/1993 | Luthra et al. | 341/61 |
| 5,341,172 | A | | 8/1994 | Nio et al. | 348/441 |
| 5,351,088 | A | | 9/1994 | Nio et al. | 348/441 |
| 5,446,496 | A | * | 8/1995 | Foster et al. | 345/531 |
| 5,459,520 | A | | 10/1995 | Sasaki | 348/445 |
| 5,459,525 | A | | 10/1995 | Izawa et al. | 348/553 |
| 5,479,184 | A | | 12/1995 | Tokimitsu | 345/3 |
| 5,488,385 | A | * | 1/1996 | Singhal et al. | 345/1.1 |
| 5,491,496 | A | | 2/1996 | Tomiyasu | 345/147 |
| 5,508,747 | A | | 4/1996 | Lee | 348/441 |
| 5,600,379 | A | * | 2/1997 | Wagner | 348/497 |
| 5,608,418 | A | * | 3/1997 | McNally | 345/3.1 |
| 5,610,942 | A | * | 3/1997 | Chen et al. | 341/61 |
| 5,623,311 | A | * | 4/1997 | Phillips et al. | 348/715 |
| 6,002,446 | A | * | 12/1999 | Eglit | 345/660 |
| 6,067,071 | A | * | 5/2000 | Kotha et al. | 345/213 |
| 6,297,849 | B1 | * | 10/2001 | Stessen et al. | 348/500 |

* cited by examiner

*Primary Examiner*—Steven Saras
*Assistant Examiner*—Srilakshmi K. Kumar
(74) *Attorney, Agent, or Firm*—Robert P. Bell; Steven Lin; Steven A. Shaw

(57) ABSTRACT

A display controller in a computer system controls the asynchronous output of graphics display data in a computer system having at least one fixed resolution flat panel display. Fixed panel displays may have problems displaying non-native resolutions particularly at lower resolutions. The controller of the present invention uses a time base converter, horizontal and vertical Discrete Time Oscillators (DTO), and polyphase interpolator, which may be Discrete Cosine Transform(DCT)-based to expand graphics display data asynchronously from native resolution to at least one resolution suitable for display on a fixed resolution panel. Graphics data may also be output asynchronously to a CRT. Time base converter receives frequency related input parameters and generates at least one asynchronous output at the desired output resolution.

18 Claims, 6 Drawing Sheets

METHOD AND APPARATUS FOR ASYNCHRONOUS DISPLAY OF GRAPHIC IMAGES

FIELD OF THE INVENTION

The present invention is in the field of portable computers, namely laptop, notebook, or similar portable computers with flat panel displays with or without SIMULSCAN™ capability. In particular, the present invention relates to displaying high resolution graphics data on fixed resolution LCD panel displays.

CROSS-REFERENCE TO RELATED APPLICATIONS

The present invention is related to application Docket Number CRUS-0059 entitled "Method and Apparatus for Expanding Graphics Images for Display on LCD Panels" incorporated herein by reference.

BACKGROUND OF THE INVENTION

A primary element of a portable computer system is a display. Since Cathode. Ray Tube (CRT) displays are relatively large and heavy, with high power requirements, other alternatives have actively been sought. Flat panel display technology represents a significant alternative to CRT display technology. Flat panel displays may have several advantages over CRT displays. Flat panel displays include a number of different display types, Liquid Crystal Display (LCD) being most commonly used. LCD displays may have advantages of being compact and relatively flat, consuming little power, and in many cases displaying color. Typical disadvantages of LCD displays may be poor contrast in bright light—especially bright natural light, inconsistent performance in cold temperatures, and display resolutions which may be constrained by a fixed number of row elements and column elements. Among these limitations, fixed resolution may cause significant problems for LCD operation in a multimedia environment. Multimedia users may demand a monitor which can be configured for different display resolutions. Analog CRT displays may be easily configured for different resolutions.

Flat panel displays may typically comprise two glass plates pressed together with active elements sandwiched between. High resolution flat panel displays use matrix addressing to activate pixels. Conductive strips for rows may be embedded on one side of a panel and similar strips for columns are located on the other side. Panels may be activated on a row by row basis in sequence. This process may be described in more detail in a text entitled: "High Resolution Graphics Display Systems", Peddie 1994 (pp. 191–225), incorporated herein by reference, however the general nature of LCD addressing is known in the art.

LCD flat panel display resolution may be dictated by physical construction of an LCD. CRT displays have a continuous phosphor coating and may be illuminated by an analog signal driving an electron beam. Because of the analog nature of CRT, scaling display resolution is relatively simple. LCD displays have a fixed array of physical pixels which may be turned on or off by applying or removing a charge. While resolution of a CRT may be changed by changing scanning frequency parameters, LCDs are limited by a fixed number of row and column elements. Fixed resolution LCD displays are particularly troublesome in multimedia systems. Such systems may require changes in display resolution to take full advantage of applications displaying high resolution graphics. In addition, for a manufacturer of display controllers to claim full VGA, SVGA, and XGA compatibility limitations of fixed panel resolution must be overcome.

TABLE 1

Vertical scanning frequencies for different graphics display modes

| Panel Type | Typical Resolution | Vertical Scan Frequency |
|---|---|---|
| VGA Panel | 640 × 480 | 25 MHz |
| SVGA Panel | 800 × 600 | 40 MHz |
| XGA Panel | 1024 × 768 | 65 MHz |

Like an analog CRT, an LCD panel may be controlled by a horizontal and vertical scanning signal. Data may be displayed in its respective screen position during an interval in time corresponding to when vertical and horizontal scan signals for a particular location coincide. Horizontal and vertical scan signals are set at a frequency proportional to display resolution. Table 1 contains vertical scanning frequencies for popular graphics display modes. Typical vertical scanning frequencies may be 25 MHz for 640 pixels by 480 pixels display, 40 MHz for 800 pixels by 600 pixels, and 65 MHz for 1024 pixels by 768 pixels. New panels comprising 1280 pixels by 960 pixels may: have an even higher vertical scanning frequency. A high resolution display therefore may have a higher scanning frequency than a relatively lower resolution display.

Using the general principal stating high frequency is proportional to high resolution, some downscaling may be achieved by attempting to replicate lower scanning frequencies of low resolution display while maintaining native scanning resolution. On a fixed resolution display of 600 pixels by 800 pixels for example, a 640 pixel by 480 pixel resolution output may be scaled by lowering the frequency at which data is clocked to the display. This type of approach to expansion related problems may be considered synchronous. Synchronous approaches may have disadvantages for expanding certain resolutions.

Because of the relationship between scan frequencies for certain resolutions that need to be expanded, synchronous approaches to expansion may not be desirable. Visual anomalies such as flicker, and related line dropping may cause noticeable and annoying visual artifacts. Also, horizontal flicker may be noticed and is even more annoying as portions of the display shift from side to side. This is due to the inability of the expansion scheme to account for every line generated at one resolution to a corresponding line on a second resolution. Resolutions which divide evenly into each other may be best suited for synchronous approaches.

Asynchronous approaches may be necessary when the ratio of CRT display lines and LCD display lines, based on different desired display resolution and fixed resolution display capability, is non-integral and when it is generally considered desirable to decouple the time base upon which display data is generated from the time base upon which output display resolution is generated. Consider an example when 3 LCD display lines must be displayed for every 2 CRT lines.

Prior art methods use relatively expensive dual path approaches which may replicate hardware for each display sought to be driven. In addition to hardware costs, bandwidth requirements may be approximately doubled and available bandwidth cut by approximately half for a dual path approach. Other disadvantages of a dual path approach may be non-transparency of software. With a dual path approach, display related software may require separate modification to standard register contents, standard addresses or the like in order to operate at each resolution.

For transforming graphics resolutions, fewer problems are inherent in downscaling, when desired display resolution is larger than the panel. Upscaling however may present special problems. When attempting to display lower resolution graphics on a higher resolution, fixed resolution panel display a variety of compensation methods may be used. Compensation features may be made available through use of shadow registers and extension registers. Both compensation method and desired parameters, such as output resolution may be set through use of registers.

Some systems employ a compensation technique known as centering. With centering, a smaller resolution graphic image may be placed within a larger resolution display in the center of the display. One problem associated with centering a 640 pixel by 480 pixel display at full color within, for example, a 1024 pixel by 768 pixel display is limited bandwidth. On a display which supports 640 pixels by 480 pixels in native mode (e.g at native 640 pixel by 480 pixel timing of 25 Mhz), there may be sufficient bandwidth to support 24 or 32 bits per pixel of color. As frequency increases such as on a fixed panel 1024 pixel by 768 pixel display which does not support the native timing for 640 pixels by 480 pixels resolution, bandwidth requirements increase in proportion to increase in frequency between resolutions. Most 32 or 64 bit controller may only support 24 or 32 bit full color at a native resolution of 640 pixels by 480 pixels. Another problem with centering and prior art expansion techniques is the scope of programming required to support it. Many shadow registers must be programmed, and protection mechanisms must be in place to configure and then preserve the expanded display settings.

FIG. 1 is a diagram illustrating a prior art technique of centering. During centering, Graphics Window 200 with a resolution of 640 pixels by 480 pixels may be displayed on Fixed Resolution Panel 201 which is capable of displaying at a fixed resolution of 1024 pixels by 768 pixels. Graphics Window 200 may be generated by a software application such as a computer game with high resolution graphics. For consistency and compatibility purposes, such a computer game may generate a display with a resolution of 640 pixels by 480 pixels regardless of the resolution capability of the display.

Differences in size must be accommodated to physically center a smaller display within a larger resolution panel. Additionally, differences in normal VGA timing which may be around 25 MHz, and native timing of an LCD panel which, for a 1024 pixel by 768 pixel display, may be around 65 MHz must be accommodated. In other words, during centering, a panel must actively accommodate the difference between lower resolution graphics mode and higher resolution panel by generating blank pixels. The resulting display is often too small to be viewed acceptably. For a 1024 by 768 pixel panel there may be 9 or 10 inches of display surface of which one third may go unused during centering. Not only does this waste panel capability, but refresh rates are poor because of timing translation and often the displayed information is too small to read either in Windows™ or in DOS text mode. From an economic standpoint, a user pays a premium for the increased resolution of the panel display only to receive inferior performance.

Another compensation technique for vertical scaling is known as line replication. In line replication or stretching, every Nth line may be duplicated on a subsequent line. In text mode, blank line insertion may be used to evenly fill an entire panel.

Yet another problem arises when attempting to drive two display devices with different display resolutions either through a SIMULSCAN™ output or an auxiliary output. For example, if Microsoft™ Windows™ is running, a dual display mode may be activated by way of an icon as is done for SIMULSCAN™ displays. Requests may then be passed by Windows™ Graphic Driver Interface (GDI) to an appropriate display driver and hardware. Only one graphics resolution, however, may be selected for one or both displays at one time. In other words, separate display resolutions may not be desirable for each display in a particular SIMULSCAN™ environment. Thus, on a notebook system with an 800 pixel by 600 pixel LCD display, if a 640 pixel by 480 pixel resolution is chosen, for example, to drive an external LCD projection panel as a SIMULSCAN™ output, then the LCD output must either be "centered" as described earlier or otherwise accommodated.

Typically, fixed resolution panels present the most difficulties in graphics scaling since other elements may more often be flexible. Every resolution capable of being generated by a system must be capable of being displayed on a fixed panel for true compatibility. Some CRT based projection systems, however, may be inflexible as to timing and resolution parameters and thus must be used in their native resolutions only. This native resolution may present special difficulties as it may use non-standard timing or resolution.

A typical native resolution for projection CRT displays is 640 pixels by 480 pixels. Use of fixed resolution projection systems leads to problems with fixed resolution panels in cases where projection system resolution does not match panel resolution. In such a case, shutting off LCD panel display may be an undesirable alternative. Another undesirable alternative may be the dual path method previously described which allows independent display of any two resolutions.

When such multimedia display equipment is used with conventional portable computers, because of fixed resolution related problems, a single display resolution only may be displayed on both displays (internal or projected) at the same time. In many instances, it may be desirable to project presentation material on an external monitor while displaying other information (e.g., speaker's notes) on an internal display. It may also be desirable to switch between internal and external displays, such that a speaker may preview an image prior to projection display. Furthermore, a need for two video displays containing different images may arise in other situations where computers are used, such as CAD systems, spreadsheets, and word processors. In particular, use of Windows™ may make it desirable to allow a user to open one window (or application) on a first video display (e.g., laptop flat panel display) and open another application on another display (e.g., external monitor). Thus, for example, a user may be able to display a scheduler (daily organizer) program on one display while operating a word processing program on another.

Popular prior art approaches to providing multiple displays with different images driven by one computer such as in the dual path method previously described have disadvantages beyond mere hardware cost. In lap-top or notebook computers, dual path methods may increase power drain, weight and size in addition to cost. Minimizing power, cost, size, and weight is especially critical in highly competitive notebook computer markets.

Other methods to drive two displays involves two display signals sharing refresh rates. To faithfully provide two distinct display resolutions, it may be desirable to generate two separate signals for two video displays having different resolutions, pixel depths, and/or refresh rates. For example, it may be desirable to generate two displays in different graphics modes, or one display in a graphics mode and another in text mode. Moreover, two different displays (e.g., flat panel display and CRT) may use refresh rates different from one another. Alternately, one display may provide improved performance operating at a particular refresh rate unavailable for the other display. In the context of upscaling an image to a fixed resolution display however, traditional methods such as interpolation may not be available or may be inefficient.

Interpolation is a well-known prior art technique used for upscaling video images. In an interpolation scheme, several adjacent pixels in a source video image are typically used to generate additional new pixels. During vertical interpolation of source image data, throughput performance problems may be encountered in a scan-line-dominant-order-of-storing scheme because vertical interpolation usually requires pixels from different scan lines. Accessing different scan lines may require retrieving data from different pages of display memory forcing a non-aligned or non-page mode read access. A non-page mode read access may require more clock cycles than a page mode access for memory locations within a pre-charged row. Thus average memory access time during vertical interpolation may be much higher than consecutive memory accesses within the same row. High average memory access time during vertical interpolation may result in a decrease in the overall throughput performance of a graphics controller chip.

To minimize number of accesses across different rows, a graphics controller chip may retrieve and store a previous scan line in a local memory element. For example, with respect to FIG. 2, a graphics controller chip may retrieve and store all pixels corresponding to scan line A–B and store retrieved pixels in a local memory located in a graphics controller chip. The graphics controller chip may then retrieve pixels corresponding to scan line C–D, and interpolate using pixels stored in local memory.

SUMMARY OF THE INVENTION

In a computer system with at least one fixed resolution panel display and a fixed resolution CRT display such as a projection display, a display controller may be used for outputting at least one asynchronous display resolution to a fixed resolution panel display. Display data may be received by the controller in one resolution, for example 640 pixels by 480 pixels. The display data may be output to a CRT display and a time base converter for asynchronously converting display data to a resolution which matches a fixed higher resolution panel which may be at a fixed resolution of 600 pixels by 800 pixels, 1024 pixels by 768 pixels or the like.

A time base converter for comparing different timing signals and controlling asynchronous output of display lines according to a predetermined relationship may receive timing input from vertical clock VCLK, dot clock DCLK, CRT horizontal refresh CRT HDSIP, and LCD horizontal refresh LCD HDISP signals. A Horizontal Discrete Time Oscillator may receive input from $H_{SIZE\ CRT}$ size of CRT horizontal line, $H_{TOTAL\ LCD}$ total horizontal lines for LCD, and may output a Horizontal Phase signal to a Polyphase Interpolator which may control interpolation of pixels received from a line buffer, from a first and second D-type flip-flop, and directly from a time base converter. A line buffer as described may also function as a vertical line filter. In addition, a signal representing LCD HDISP may be output from a Horizontal Discrete Time Oscillator and input to a time base converter such as described above. A Vertical Discrete Time Oscillator may receive inputs from N and D signals representing Numerator and Denominator respectively. Also, a Vertical Phase signal may be output to a Polyphase Interpolator such as described above. An End of Scan (EOS) signal may be input to a time base converter such as described above to control the end of a vertical scanning sequence. Output from a Polyphase Interpolator may be input to an LCD panel interface which may be used to drive an LCD panel.

A line buffer such as described may receive and store a scan line of display data and two flip-flop elements may be used to delay input of display data to a polyphase interpolator by one clock cycle for the flip-flop elements and one scan line cycle for the line buffer respectively. Thus, four adjacent pixels may be input simultaneously into a polyphase interpolator for upscaling in the following manner. Display data generated within core VGA logic may be output a time base converter. A time base converter outputs display data to a CRT display, a line buffer, an input terminal of a polyphase interpolator, and a flip-flop element. Flip-flop element output may be input to another input terminal of a polyphase interpolator, line buffer output may be input to yet another input terminal of a polyphase interpolator and another flip-flop element. Finally flip-flop output associated with line buffer output may be input to a fourth input terminal of a polyphase interpolator. Thus, four inputs with associated delays, create four pixels horizontally and vertically adjacent being input to a polyphase interpolator which may then upscale graphics data to desired output display resolution. Interpolation may be accomplished using a Discrete Cosine Transform upon input pixels. Interpolation may be used to upscale lower resolution display data to a fixed resolution panel of higher resolution.

BRIEF DESCRIPTIONS OF THE DRAWINGS

DETAILED DESCRIPTION OF THE INVENTION

The descriptions herein are by way of example only illustrating the preferred embodiment of the present invention. However, the method and apparatus of the present invention may be applied in a similar manner in other embodiments without departing from the spirit of the invention.

Figure 1:
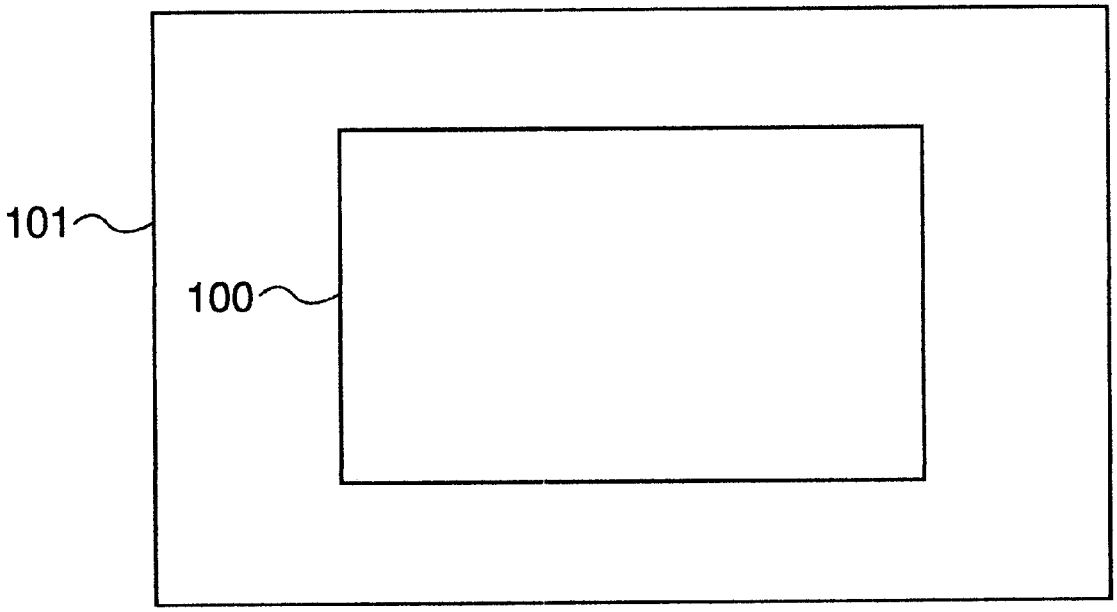
Figure 1 (Prior Art)
FIG. 1 is a diagram illustrating a prior art technique of centering.
Figure 2:
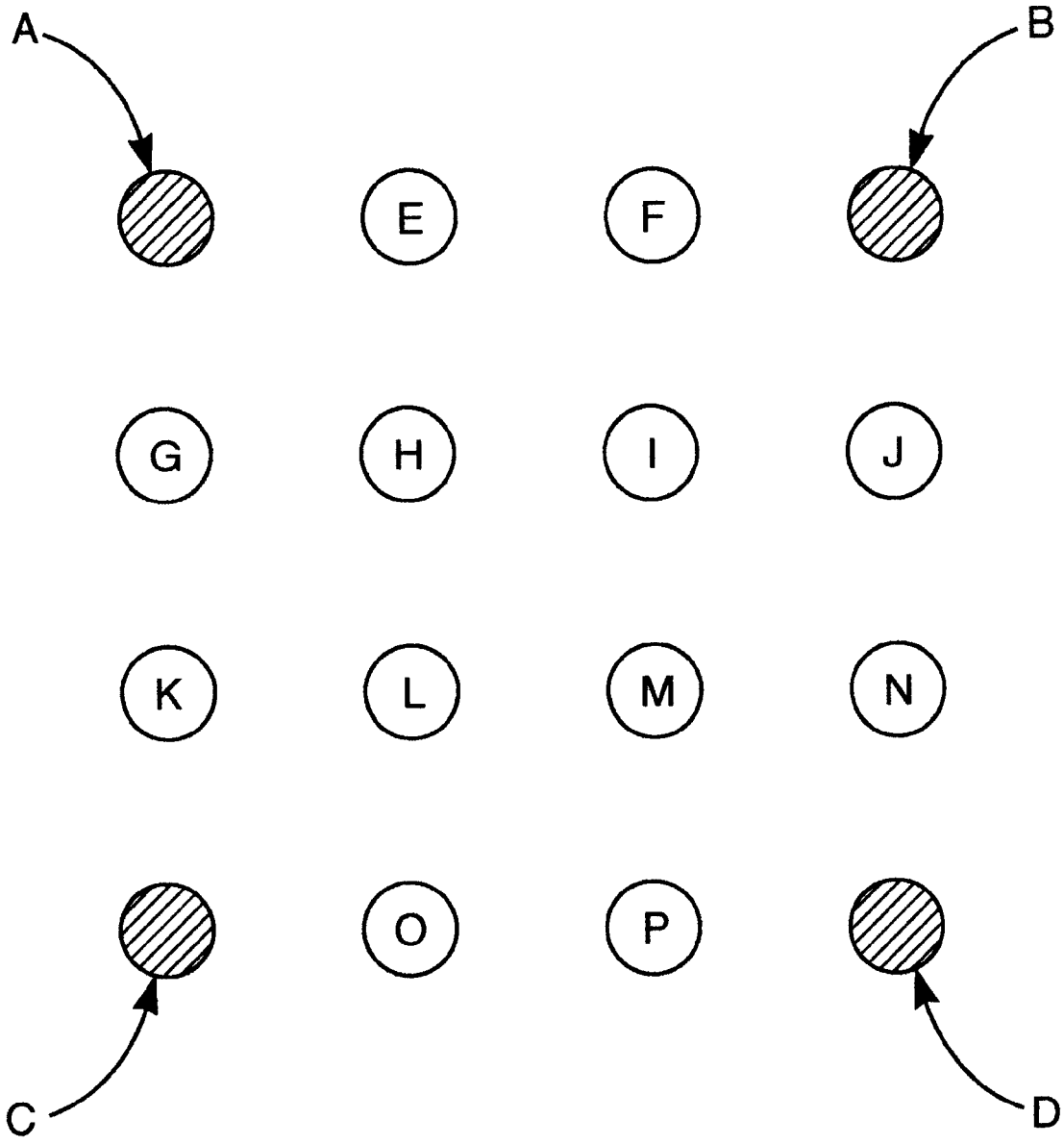
FIG. 2 is a diagram illustrating adjacent source pixels and pixels generated through interpolation.

FIG. 2 is a diagram illustrating adjacent source pixels and pixels generated through interpolation. FIG. 2 shows pixels (A, B, C, and D) of the original source video image and pixels (E–P) which are generated by interpolation resulting in upscaling the original source video image. Pixel E may be generated, for example, by formula (2/3 A+1/3 B). If each pixel is represented in RGB format, RGB components of pixel E may be generated by using corresponding components of pixels A, B. Pixel K may similarly be generated using the formula (1/3 A+2/3 C). Generation of pixels such as E, F may be termed horizontal interpolation as pixels E, F are generated using pixels A, B located horizontally. Generation of pixels such as G, K may be termed vertical interpolation.

Figure 3:
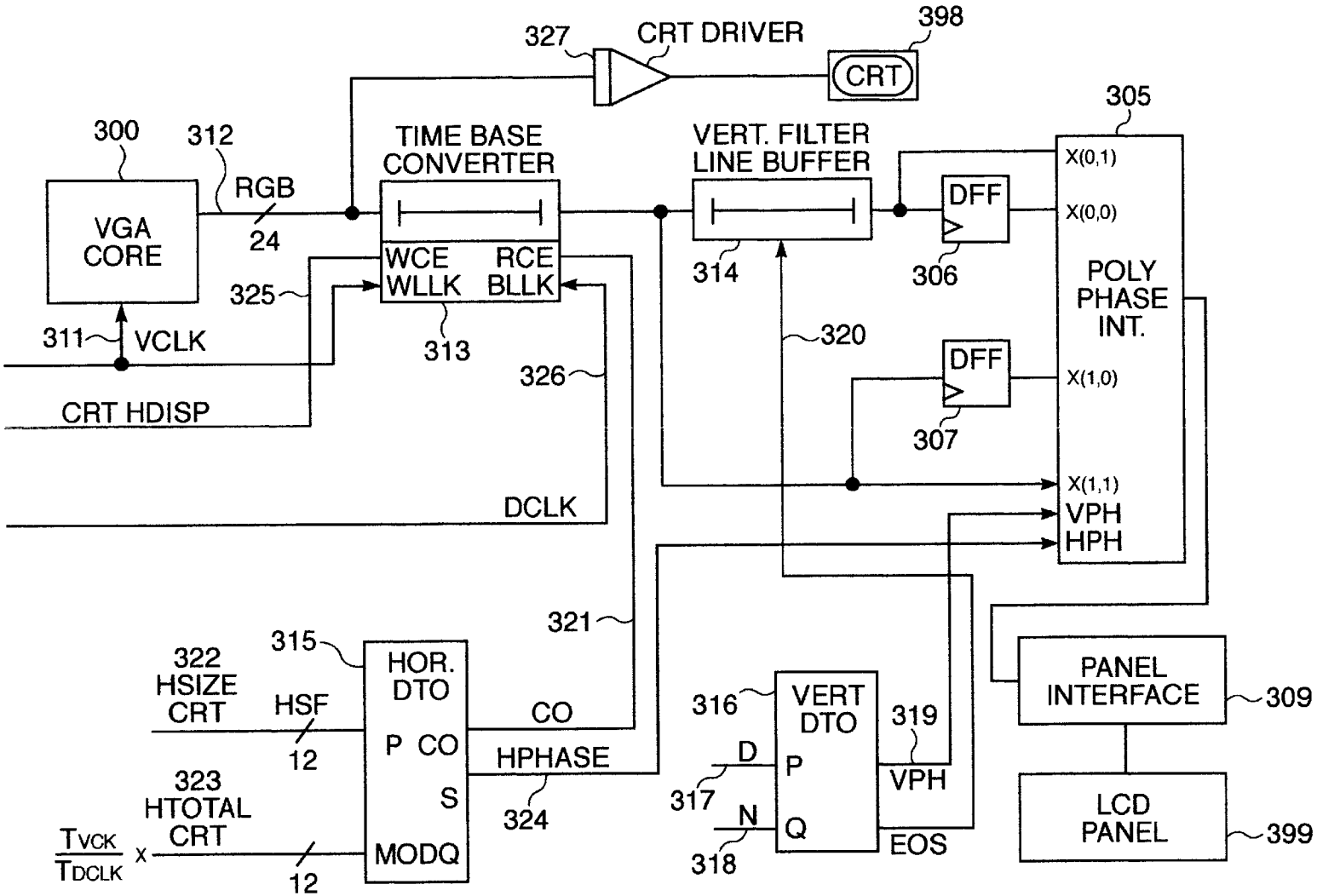
FIG. 3 is a block diagram illustrating components associated with the asynchronous expansion circuit of the present invention.

FIG. 3 is a block diagram illustrating components associated with the asynchronous expansion circuit of the present invention. Expansion parameters used in the asynchronous expansion circuit of the present invention may be calculated as follows. Given the following parameters, $H_{SIZE\ LCD}$—horizontal size of an LCD panel in pixels, $H_{SIZE\ CRT}$—horizontal size of a CRT in pixels, $V_{SIZE\ LCD}$—vertical size of the LCD in pixels, $V_{SIZE\ CRT}$—vertical size of the CRT in pixels, $H_{TOTAL\ CRT}$—horizontal total pixels for the CRT, $V_{TOTAL\ CRT}$—vertical total pixels for the CRT, and $F_V=1/T_V$ vertical frame rate or frequency, calculate frame clock rate $F_{VCLK}$ and $T_{VCLK}$, vertical upscaling ratio, $H_{TOTAL\ LCD}$ and $F_{DCLK}$ and $T_{DCLK}$, and reference parameters using equations 1–6.

For a given frame rate $F_V$, $F_{VCLK}$ and $T_{VCLK}$ may be calculated as follows:

$$F_{VCLK}=V_{TOTAL\ CRT}\cdot H_{TOTAL\ CRT}\cdot F_V \quad (1)$$

$$T_{VCLK}=1/F_{VCLK}=T_V/(V_{TOTAL\ CRT}\cdot H_{TOTAL\ CRT}) \quad (2)$$

To achieve proper upscaling, a ratio must be chosen which minimizes the size of the numerator and denominator such that:

$$N/D=V_{SIZE\ LCD}/V_{SIZE\ CRT} \quad (3)$$

Next, $H_{TOTAL\ LCD}$ may be selected based on horizontal retrace requirements, and $T_{DCLK}$ may be selected and minimized using the following relationship:

$$H_{TOTAL\ CRT}=D/N\cdot T_{VCLK}/T_{DCLK}\cdot H_{TOTAL\ LCD} \quad (4)$$

Calculate other timing parameters for reference purposes using the relationships:

$$V_{TOTAL\ LCD}=N/D\cdot V_{TOTAL\ CRT} \quad (5)$$

$$T_{H\ LCD}=H_{TOTAL\ LCD}\cdot T_{DCLK} \quad (6)$$

To determine Vertical DTO 316 and Horizontal DTO 315 parameters, the following equation may be used:

$$\text{PARAM/MODULO}=(V_{SIZE\ CRT}\cdot H_{TOTAL\ CRT})/(V_{SIZE\ LCD}\cdot H_{TOTAL\ LCD}) \quad (7)$$

PARAM may represent the P input to, for example, Horizontal DTO 315. MODULO may represent the MOD Q input to Horizontal DTO 315. When PARAM value reaches MODULO value, an output is generated which, in the case of Horizontal DTO 315 represents when sufficient HSIZE CRT 322 input has been received to fill the CRT, or a count equal to HTOTAL CRT 323 has been reached.

VGA core 300 represents a standard VGA controller known in the art for generating display data. VGA Core 300 may generate and output display data lines at a pixel frequency which corresponds to the display resolution for, in the preferred embodiment, a CRT projection panel. Lines 312 generated in RGB format at 24 bits per pixel in the preferred embodiment are output at a frequency 311 to CRT Driver 327 and Time Base Converter 313. Lines 312 may also be generated at 32 bits per pixel. In the preferred embodiment, VGA Core 300 may generate display information at a frequency corresponding to 640 pixels by 480 pixels. CRT Driver 327 outputs lines to a CRT display 398 such as a projection screen which may employ standard CRT (RGB) display technology known in the art.

Figure 5:
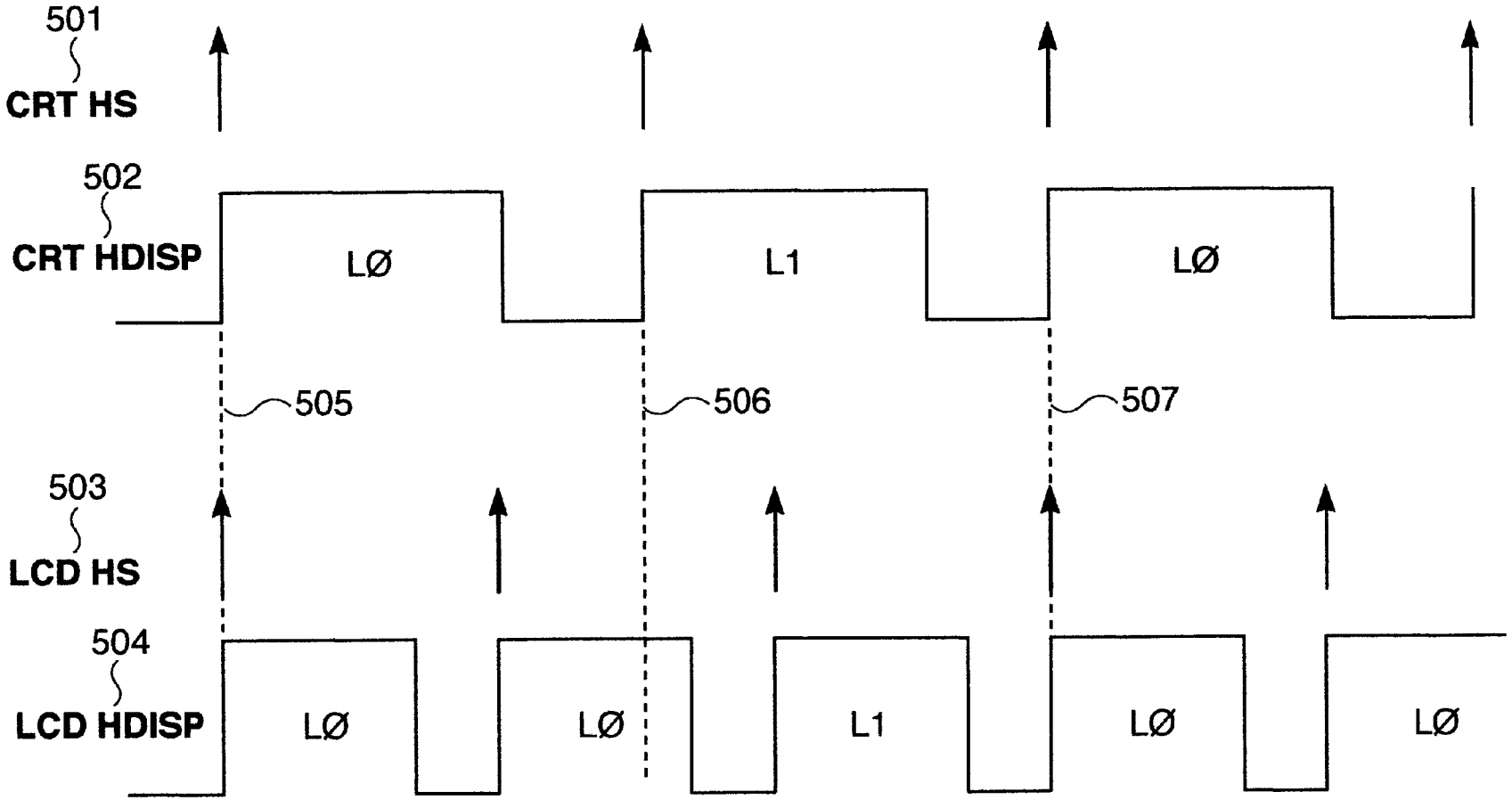
FIG. 5 is a timing diagram illustrating the timing relationship between lines generated for a CRT and lines generated for an LCD panel.

Time Base Converter 313 may receive inputs from VGA Core 300, VCLK 311, CRT HDISP 325 which is the horizontal retrace signal for the CRT, DCLK 326 or "Dot Clock" which is the rate at which pixels are output from VGA Core 300, and Carry Out signal 321 and may use equations 1–6 to perform time base conversion between CRT lines and LCD lines in the following manner. Lines may be received at DCLK 326 proportional to CRT 398 resolution. Inside Time Base Converter 313 which also acts as a line store or line buffer, lines received at frequency 311 are compared against the lines required LCD panel display 399 frequency. FIG. 5 illustrates the timing relationship between CRT lines and LCD lines. Since, for LCD panels of a higher resolution than CRT resolution, lines are required by LCD panel display 399 at a faster rate than lines are generated for CRT 398, duplicate lines must be output to LCD panel display 399. FIG. 5 illustrates how lines are asynchronously generated for LCD panel display 399 and CRT 398. Since LCD panel display 399 is of a higher resolution than CRT 398 another line is required before the end of a line timing interval for CRT 398. Line 312 in progress for CRT 398 will be repeated for LCD panel display 399.

Display Data output from Time Base Converter 313 may be input to Vertical Filter/Line Buffer 314, D-type Flip-flop 307 and Polyphase Interpolator 305. Vertical Filter/Line Buffer 314 may receive display data from Time Base Converter 313 and filter display data using, for example, in the preferred embodiment, a Discrete Cosine Transform filter. Display data may be stored in Vertical Filter/Line Buffer 314 under control of Vertical Discrete Time Oscillator (DTO) 316 which may issue signal EOS 320 for signalling the end of a vertical scan. Display data output from Vertical Filter/Line Buffer 314 may be input to Polyphase Interpolator 305 and D-type Flip-flop 306.

Horizontal DTO 315 and Vertical DTO 316 may be used to provide and control horizonal and vertical frequency related parameters such as $H_{SIZE\ LCD}$, $H_{SIZE\ CRT}$, $V_{SIZE\ LCD}$, $V_{SIZE\ CRT}$, $H_{TOTAL\ CRT}$, and $V_{TOTAL\ CRT}$. Horizonal DTO 315 receives HSIZE CRT signal 322 indicating size of a horizontal scan and HTOTAL CRT signal 323 indicating total number of horizontal scans. HPHASE 324 represents Horizontal Phase and may be input to Polyphase Interpolator 305. Carry Out 321 from the comparison of HSIZE CRT 322 and HTOTAL CRT 323 of Horizontal DTO 315 may be input to Time Base Converter 313 and used to control the output of lines from Time Base Converter 313. Vertical DTO 316 receives D signal 317 and N signal 318 representing Denominator value D and Numerator value N in Equation 4. D signal 317 and N signal 318 may be programmed in registers or otherwise supplied by software depending on the relationships desired between parameters in Equation 4. Vertical Phase (VPH) signal 319 representing carry out is output to Polyphase Interpolator 305.

Each D-type Flip-flop 306 and 307 may add an additional cycle of delay in the vertical direction such that Polyphase Interpolator 305 receives pixels X(0,1), X(0,0), X(1,0), X(1,1). These four pixels represent two adjacent pixels in each horizontal and vertical direction. Pixels generated in Polyphase Interpolator 305, are output to Panel Interface 309 which may be used to generate display information on corresponding LCD panel display 399.

Figure 4:
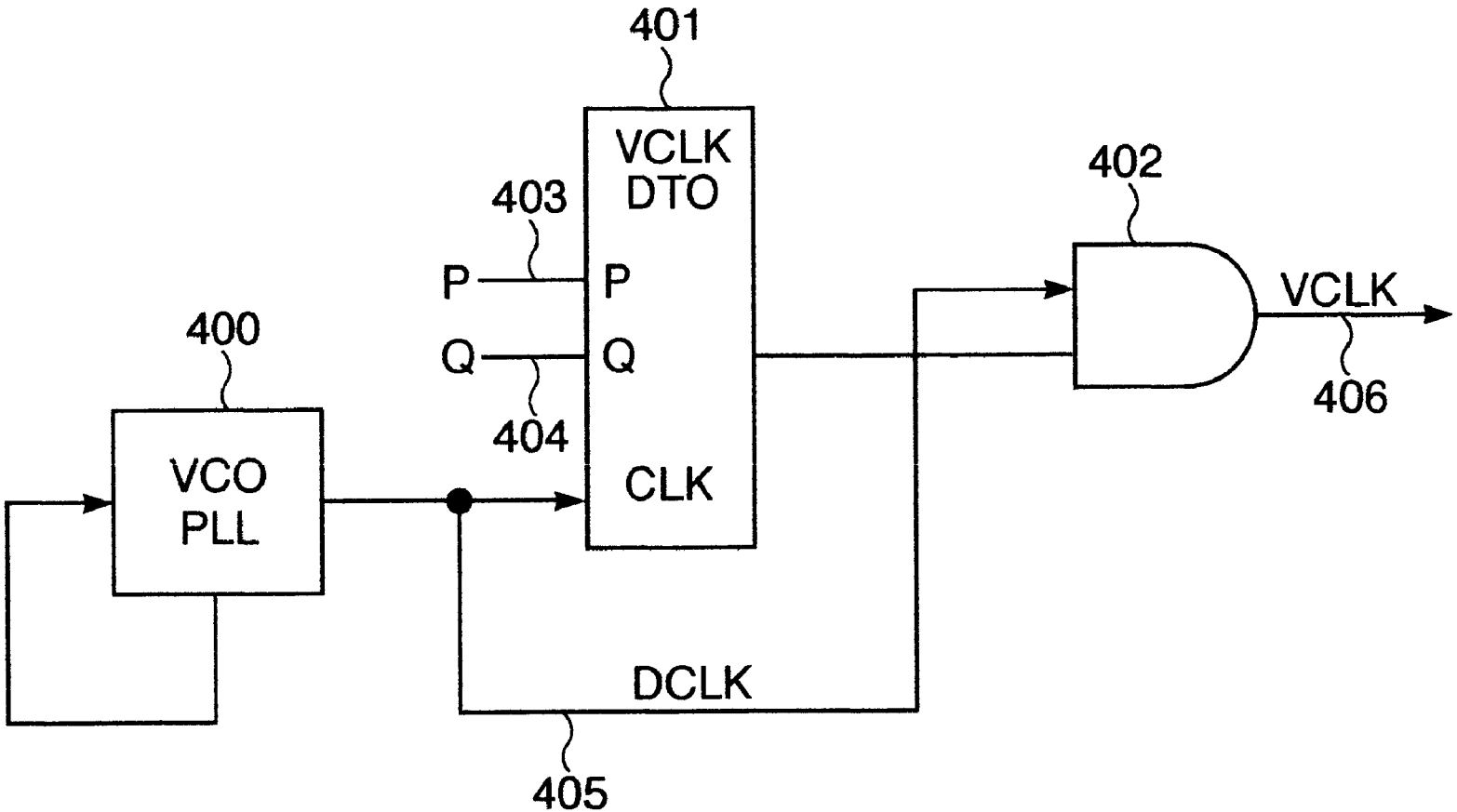
FIG. 4 is a diagram illustrating a Discrete Time Oscillator of the present invention.

FIG. 4 is a diagram illustrating a circuit for generating VCLK 406. VCO PLL 400 generates and maintains frequency stability of DCLK 405. DCLK 405 may be input to VCLK DTO 401 and gate 402. Input P 403 and input Q 404 may also be input to VCLK DTO 401 and are proportional to desired output frequency and input frequency respectively. DCLK 405 and carry out from DTO 401 may be input to gate 402 and may be used to generate VCLK 406.

FIG. 5 is a timing diagram illustrating the timing relationship between lines generated for a CRT projection display and lines generated for a fixed resolution LCD panel. CRT HS signal 501 represents a horizontal scan signal for a CRT and is synchronized with the end of CRT horizontal retrace interval as shown by time 505, 506, and 507. Times 505, 506, and 507 are illustrated as corresponding to CRT line generation. L0 and L1 are arbitrary designators use to compare timing for corresponding lines generated for both CRT display and LCD display. L0 represents line 0 and L1 represents line one; L0 and L1 are reused as reference numbers for subsequent lines. By designating L0 and L1 accordingly, the relationship between L0 generated for the CRT and L0 generated for the LCD may be seen. Data for L0 is replicated for a second LCD line during, for example, time 506. Since the present invention discloses an asynchronous relationship between CRT and LCD displays, any number of lines displayed for the LCD during the time interval between time 505 and 506 would be replicated as LO.

CRT HDISP signal 502 is shown as active during the time when a horizontal line is being displayed and not active during the retrace interval when returning to begin the next line scan. LCD HS 503 represents a horizontal scan signal for an LCD panel and coincides with the end of the retrace interval of LCD HDISP signal 504. LCD HDISP signal 504 is shown as active during the time when a horizontal line is being displayed and not active during the retrace interval when returning to begin the next scan. As shown in FIG. 5, three LCD lines may be displayed during an interval corresponding to display of two CRT lines. A scaling factor of 1.5 would result from a requirement to display 3 LCD lines for every 2 CRT lines. Any number of LCD lines may be generated asynchronously as a function of CRT lines based on a ratio of CRT resolution and LCD panel fixed resolution in accordance with Equation (3). As display data for L0 is being output as a CRT line, L0 is being output as an LCD line. L0 for the LCD is finished and a retrace interval begins before L0 for the CRT is complete. Since L0 for the CRT is still being output, then next line for the LCD begins to write L0 again. Since display data for CRT lines and LCD lines are derived from a common data stream output from VGA Core 300, only timing differences affect number of lines output to the LCD for each CRT line. Thus, within practical limitations, any number of LCD lines may be output asynchronously using display data originally generated as CRT output.

Figure 6:
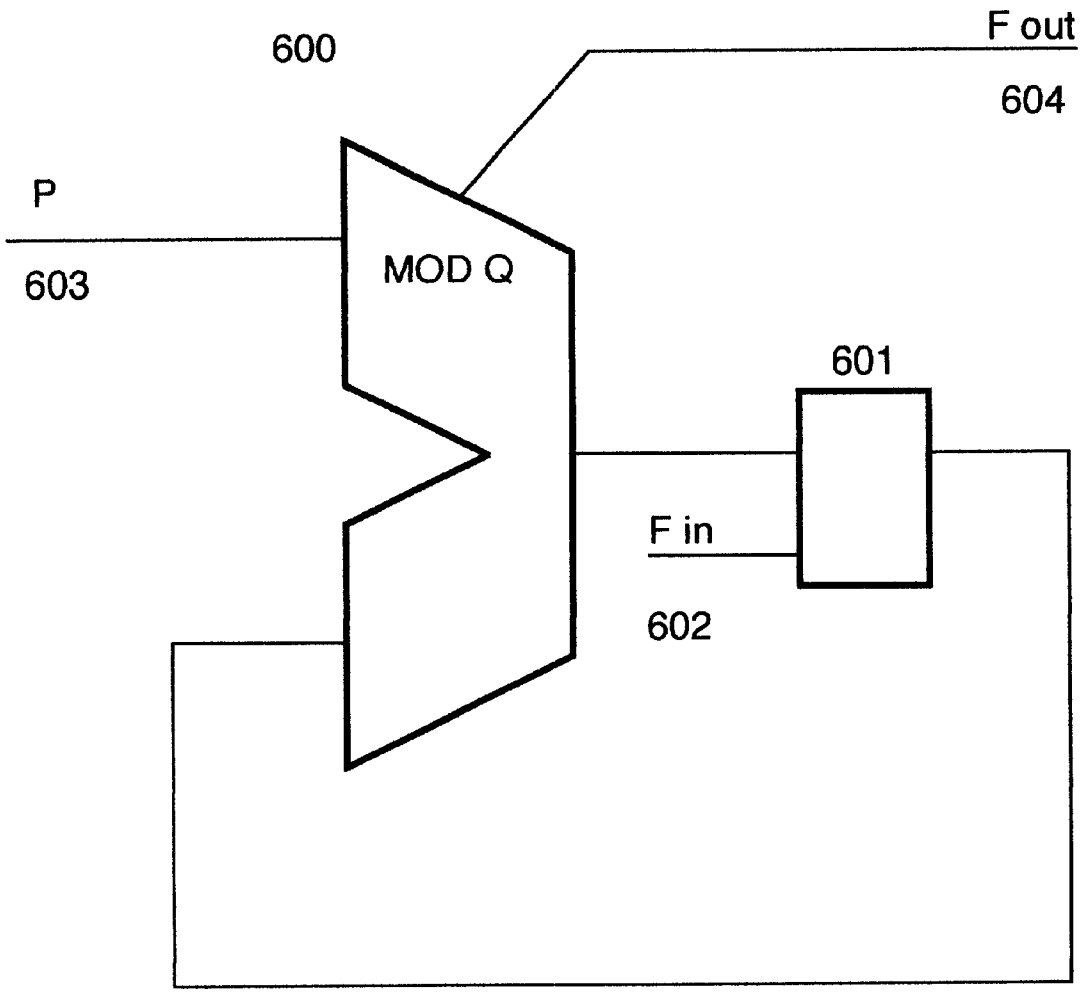
FIG. 6 is a diagram illustrating an embodiment of a Discrete Time Oscillator of the present invention.

FIG. 6 is a diagram illustrating an embodiment of a Discrete Time Oscillator of the present invention. In order to implement Horizontal and Vertical DTO block of the present invention, a circuit of the kind illustrated in FIG. 6 may be used to perform a PLL function as well as a divide function. As background to FIG. 6, equation (8) describes the relationship between values P 603, Q, $F_{in}$ 602 and $F_{out}$ 604 of FIG. 6:

$$f_{out}=f_{in}(P/Q) \tag{8}$$

Value P 603 is input to accumulator 600. Value P 603 represents the numerator of the rational expression on the right side of equation 1. Value P 603 may be proportional to the desired output frequency $F_{out}$ 604. Denominator Q may be proportional to the input frequency $F_{in}$ 602. In the preferred embodiment of the present invention, P 603 and Q may be proportional to vertical clock frequencies of desired display resolution and native display resolution respectively. Native display resolution means fixed panel display resolution. $F_{in}$ 602 may be input to the clock terminal of gate 601 which, in the preferred embodiment, may be a flip-flop. The count output of accumulator 600 may be input to gate 601. By indirectly coupling $F_{in}$ 602 through gate 601, anomalies associated with dividing are minimized. As the count increments to value P 603 on each clock transition of $F_{in}$ 602, carry out value representing mod Q is output as $F_{out}$ 604.

While the preferred embodiment and alternative embodiments have been disclosed and described in detail herein, it may be apparent to those skilled in the art that various changes in form and detail may be made without departing from the spirit and scope of the invention. For example, while interpolation in the preferred embodiment may comprise a polyphase interpolator, the present invention could be practiced with virtually any interpolation means.

Similarly, while output is drawn to a fixed resolution CRT projection panel and a fixed resolution LCD panel, the present invention could be practiced on any system which requires asynchronous display timing for multiple displays operating from the same display data stream. Moreover, although the preferred embodiment is drawn to an integrated circuit, the present invention may be applied to a series of integrated circuits, a chipset, or in other circuitry within a computer system without departing from the spirit and scope of the present invention.

We claim:

1. In a computer system, a display controller for controlling asynchronous output of a graphics data to at least one display device, said display controller comprising:

time base converter means for receiving graphics display data at a first rate, timing signals, and signals indicative of horizontal scan rate, said time base converter means for outputting the graphics display data at least one second asynchronous rate;

storage means coupled to said time base converter means for receiving and storing graphics display data at said at least one second synchronous rate and outputting the graphics display data stored therein; and interpolator means coupled to said storage means and said time base converter means for upscaling the graphics display data to at least one graphics display resolution and outputting the graphics display data to a display device, wherein said interpolator means further comprises a polyphase interpolator coupled to said storage means for receiving pixel values for at least four adjacent pixels, and wherein said interpolator means further comprises a polyphase interpolator coupled to said storage means using Discrete Cosine Transform interpolation.

2. In a computer system, a display controller for controlling asynchronous output of a graphics data to at least one display device, said display controller comprising:

time base converter means for receiving graphics display data at a first rate, timing signals, and signals indicative of horizontal scan rate, said time base converter means for outputting the graphics display data at at least one second asynchronous rate;

storage means coupled to said time base converter means for receiving and storing graphics display data at said at least one second asynchronous rate and outputting the graphics display data stored therein;

interpolator means coupled to said storage means and said time base converter means for upscaling the graphics display data to at least one graphics display resolution and outputting the graphics display data to a display device;

horizontal Discrete Time Oscillator means coupled to said interpolator means and said time base converter means for receiving at least one predetermined value proportional to a horizontal scan parameter and for outputting to said interpolator a signal indicative of a horizontal phase value and outputting to said time base converter a carry out signal; and vertical Discrete Time Oscillator means coupled to said storage means and said interpolator means for receiving a predetermined numerator value and a predetermined denominator value and for outputting a value proportional to vertical phase and a value indicating the end of a vertical scan, wherein said interpolator means further comprises a polyphase interpolator coupled to said storage means for receiving pixel values for at least four adjacent pixels, wherein said interpolator means further comprises a polyphase interpolator coupled to said storage means using Discrete Cosine Transform interpolation.

3. The display controller of claim 2, wherein said time base converter means further comprises a storage means for storing a line of graphics display data and outputting the line of graphics display data asynchronously at said at least one second asynchronous rate.

4. The display controller of claim 3, wherein said time base converter means further repeats outputting the line of graphics display data stored in said storage means if a line generated at said first rate is still being output when a subsequent line at said at least one second asynchronous rate is ready to be output.

5. The display controller of claim 2, wherein said storage means further comprises a line buffer and at least two flip-flops for storing pixel values.

6. The display controller of claim 2, wherein said interpolator means further comprises a polyphase interpolator coupled to said storage means for receiving pixel values for at least four adjacent pixels.

7. The display controller of claim 2, wherein said horizontal Discrete Time Oscillator means further receives a first predetermined value proportional to a horizontal scan line size and a second predetermined value proportional to a horizontal total size and for outputting to said interpolator a signal indicative of a horizontal phase value and outputting to said time base converter a carry out signal generated in proportion to a ratio between said first and second predetermined values.

8. A method of controlling output of graphics display data in a computer system, said method comprising the steps of:

receiving graphics display data at a first resolution, converting from a first time base corresponding to the first resolution to at least one second time base for displaying data at at least one second resolution, storing display data in a storage device and controlling the output of display data from said storage device to an interpolator, receiving at least one horizontal size parameter and outputting a horizontal phase signal and a carry out signal, receiving at least one vertical frequency parameter and outputting a vertical phase signal and an signal indicative of the end of a scan interval, interpolating graphics display data received at the at least one second resolution, and outputting graphics display data from the interpolator to at least one display device at the at least one second resolution, wherein said step of interpolation further comprises using a polyphase interpolator coupled to said storage device for receiving pixel values for at least four adjacent pixels, wherein said step of interpolation further comprises using Discrete Cosine Transform interpolation in said polyphase interpolator.

9. The method of claim 8, wherein said step of receiving at least one horizontal size parameter further comprises receiving said at least one horizontal size parameter in a horizontal Discrete Time Oscillator and outputting a horizontal phase signal and a carry out signal from said horizontal Discrete Time Oscillator.

10. The method of claim 8, wherein said step of receiving at least one vertical frequency parameter further comprises receiving said at least one vertical frequency parameter in a vertical Discrete Time Oscillator and outputting a vertical phase signal and an signal indicative of the end of a scan interval from said vertical Discrete Time Oscillator.

11. The method of claim 8, wherein said step of interpolation further comprises using a polyphase interpolator coupled to said storage device for receiving pixel values for at least four adjacent pixels.

12. A computer comprising:

a processor having core logic, primary and secondary memory, and at least one system bus, at least one display coupled to said processor for displaying graphics and text output, and a display controller coupled to said processor and said flat panel display for receiving graphics display data at a first resolution, controlling asynchronous output of graphics display data in at least one second resolution, wherein said display controller further comprises:

time base converter means for receiving graphics display data at a first rate, timing signals, and signals indicative of horizontal scan rate and for outputting the graphics display data at at least one second asynchronous rate;

storage means coupled to said time base converter means for receiving and storing graphics display data at said at least one second asynchronous rate and outputting the graphics display data stored therein at said second asynchronous rate;

interpolator means coupled to said storage means and said time base converter means for receiving display data at said second asynchronous rate upscaling the graphics display data to at least one graphics display resolution;

horizontal Discrete Time Oscillator means coupled to said interpolator means and said time base converter means for receiving a predetermined value proportional to a horizontal scan line size and for outputting a value proportional to a horizontal phase to said interpolator; and vertical Discrete Time Oscillator means coupled to said storage means and said interpolator means for receiving a predetermined numerator value and a predetermined denominator value and for outputting a value proportional to vertical phase and a value indicating the end of a vertical scan, wherein said storage means further comprises a line buffer and at least two flip-flop elements for storing pixel values, wherein said interpolator means further comprises a polyphase interpolator coupled to said storage means for receiving pixel values for at least four adjacent pixels, and wherein said interpolator means further comprises a polyphase interpolator coupled to said storage means using Discrete Cosine Transform interpolation.

13. The computer of claim 12, wherein said control means further comprises at least one register means for storing a predetermined ratio corresponding to a present input resolution and a desired output resolution for the graphics display data.

14. The computer of claim 13, wherein said at least one display comprises a flat panel display having a fixed resolution.

15. The computer of claim 14, further comprising at least two displays wherein a first display comprises a flat panel display with a fixed resolution, and a second display comprises a fixed resolution CRT display.

16. The computer of claim 15, wherein said predetermined numerator received by said vertical Discrete Time Oscillator means is proportional to the vertical size of an LCD panel and said predetermined denominator received by said vertical Discrete Time Oscillator means is proportional to the vertical size of a CRT display.

17. The computer of claim 16, wherein said LCD panel is a fixed resolution LCD panel and said CRT display is a fixed resolution CRT projection display.

18. A The computer of claim 17, wherein said LCD panel is a fixed resolution LCD panel and said CRT display is a fixed resolution projection display and the resolution of said fixed resolution CRT projection display is lower than the resolution of said fixed resolution LCD display.

* * * * *